United States Patent [19]

Buras, Jr. et al.

[11] 4,106,190

[45] Aug. 15, 1978

[54] HAIR CLIPPER

[75] Inventors: Edmund Maurice Buras, Jr., Silver Spring; Allan Carl Harper, Gaithersburg, both of Md.

[73] Assignee: The Gillette Company, Boston, Mass.

[21] Appl. No.: 750,211

[22] Filed: Dec. 13, 1976

[51] Int. Cl.[2] ..... B26B 19/20

[52] U.S. Cl. ..... 30/43.7; 30/216; 30/220; 30/225

[58] Field of Search ..... 30/216, 220, 201, 223–225, 30/34.1, 43.7, 43.2

[56] References Cited

U.S. PATENT DOCUMENTS

| | | | |
|---|---|---|---|
| 807,435 | 12/1905 | Burgman | 30/216 |
| 1,332,553 | 3/1920 | Halterman | 30/43.2 |
| 1,815,817 | 7/1931 | Albertson | 30/216 |
| 2,274,924 | 3/1942 | Hill | 30/225 |
| 2,596,078 | 5/1952 | Prohaska | 30/223 |
| 3,531,862 | 10/1970 | Bender et al. | 30/201 |

*Primary Examiner*—Robert C. Watson
*Attorney, Agent, or Firm*—Richard A. Wise; Oistein J. Bratlie; Donald E. Mahoney

[57] ABSTRACT

A hair clipper is arranged to alleviate one cause of pseudofolliculitis. The hair clipper comprises a motor for reciprocally moving a first cutter against low-lying facial hairs causing these hairs to become erect for cutting above the skin line between the moving first cutter and a stationary second cutter.

8 Claims, 4 Drawing Figures

HAIR CLIPPER

BACKGROUND OF THE INVENTION

1. Field of the Invention

This invention relates to hair clippers and, more particularly, to hair clippers adapted to erect low-lying facial hairs for cutting above the skin line.

2. Description of the Prior Art

Implements such as razors or electric shavers for cutting or shaving hair are well known in the prior art. Conventional shaving implements include a handle adapted to be manually held and means for mounting a blade on the handle. Most prior art shaving implements for cutting human facial hair are designed to cut hair as close to the skin line as possible without nicking or cutting the skin. Toward this end, shaving implements have included a reciprocally moving guard member arranged to contact the face of a user so as to move facial hairs against a stationary blade to provide high cutting efficiency and close shaves. An example of such a shaving implement is disclosed in U.S. Pat. No. 3,918,154 entitled "Razor With Reciprocating Guard", issued to Alfred J. Pagani, Nov. 11, 1975. However, prior art shaving implements designed to provide a close shave are unsuitable for use by people who suffer from a condition of pseudofolliculitis or superficial inflammation of one or more hair follicles caused by ingrown hairs. It has been determined that hair cut close to or below the skin line tends to aggravate a pseudofolliculitis problem since close cut hairs sometime become ingrown.

Obviously, a shaving implement designed to cut facial hair above the skin line would probably prevent one cause of a pseudofolliculitis condition but would not offer a means for alleviating the problem. For example, shaving implements such as a prior art electric clipper with a stationary cutter normally held in contact with a user's beard are adapted to cut hair above the skin line. However, such a prior art electric clipper would not cut hairs emerging from the skin at a low angle. These low-lying hairs are a cause of pseudofolliculitis when they become ingrown by penetrating the stratum corneum across furrows and crevices in rough skin after about 2 days growth.

Accordingly, an electric shaving implement is arranged to cut hair, including low-lying facial hairs, so that all hairs are cut above the skin line to a length selected to minimize future penetration of the cut hair into the skin.

SUMMARY OF THE INVENTION

A hair clipper comprises a housing, a first cutter having a plurality of teeth and a second cutter having a plurality of teeth. The second cutter is assembled between the housing and the first cutter with the first cutter teeth projecting beyond the second cutter teeth. The hair clipper includes means for reciprocally moving the first cutter against the second cutter in a lateral direction substantially parallel to extreme edges of the second cutter teeth.

DESCRIPTION OF THE PREFERRED EMBODIMENT

Figure 1:
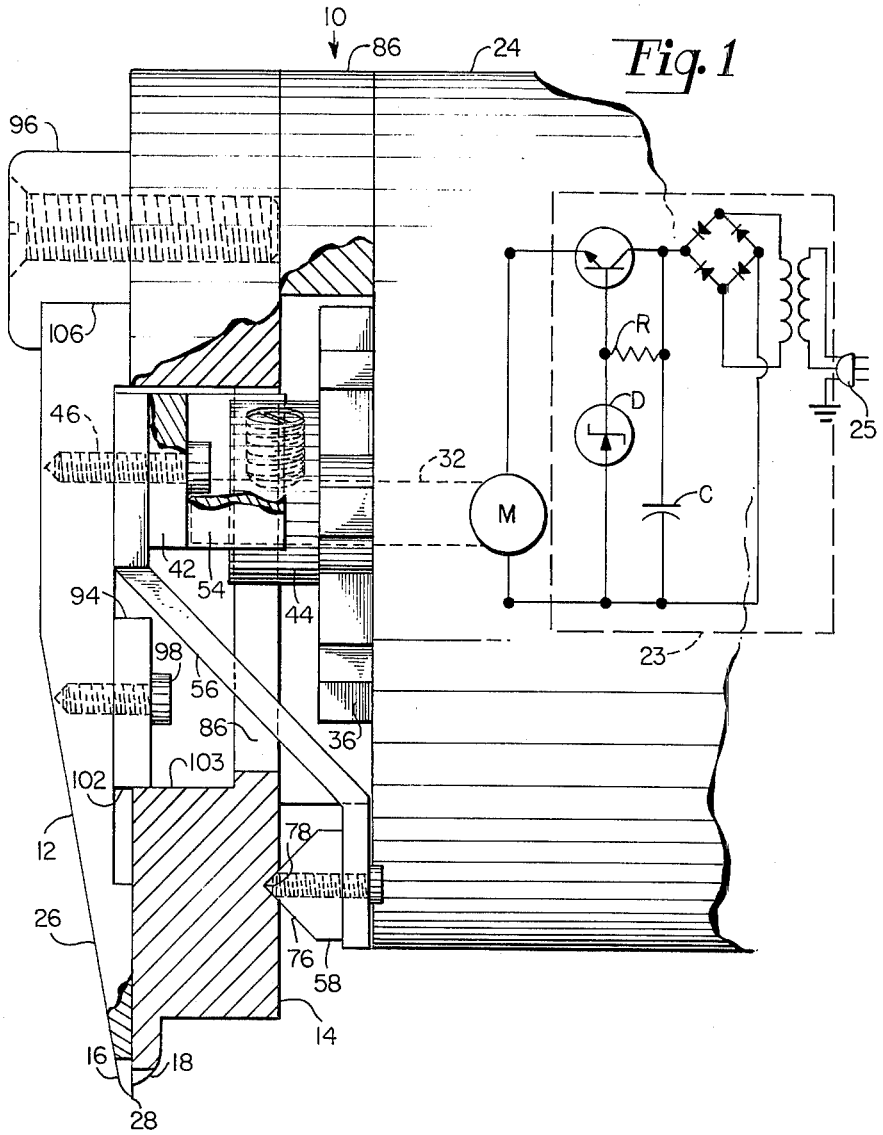
FIG. 1 is a longitudinal view, partially in section, of the forward end of a hair clipper according to one embodiment of the invention.
Figure 2:
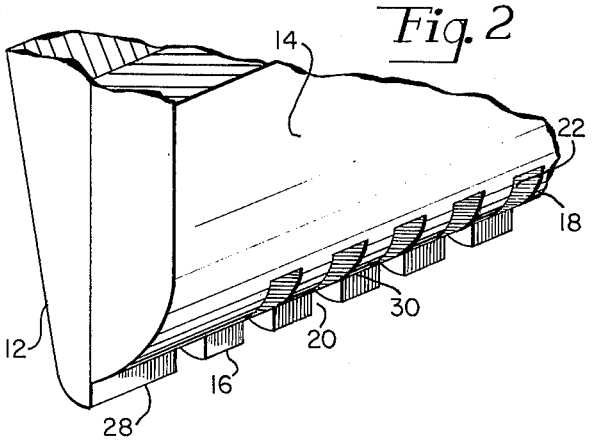
FIG. 2 is a detailed perspective drawing of cutter teeth.

Referring to FIG. 1, there is shown a longitudinal view, partially in section, of a hair clipper 10 having a lower cutter 12 and an upper cutter 14. Both the lower and upper cutters 12 and 14 have a plurality of square-shaped teeth 16 and 18 and slots 20 and 22 shown in detail in FIG. 2. Unlike conventional clippers having a stationary lower cutter, a preferred embodiment of the hair clipper 10 is arranged to provide means for reciprocally moving the lower cutter 12 laterally across the upper cutter 14. Hairs disposed between the slots 20 and 22 of the upper and lower cutters, respectively, are sheared at points where the lower cutter 12 reciprocally moves against the upper cutter 14 in response to a suitable high speed motor, M, disposed in a cylindrical housing 24. Under operating conditions, a user would couple a source of electrical energy, not shown, to the motor via a plug 25 and hold the clipper 10 against an area to be shaved so that hairs are disposed between the cutter slots 20 and 22. These hairs are cut as the moving lower cutter 12 is passed over the shaving area. The lower cutter 12 is formed to have more teeth 16 than the upper cutter 14 so that the cutters 12 and 14 might efficiently shear hairs in the slots 20 and 22 progressively along a row to prevent a simultaneous cutting of the hairs in a selected area, whereby substantially all hairs are cut to a uniform length. The lower cutter 12 is reciprocally moved at a high rate of speed relative to a moving cutter in a prior art clipper to decrease beard pull in the shaving area and to increase the efficiency of cutting short hairs. For example, in a preferred embodiment, the lower cutter 12 has approximately fifty teeth per inch and the upper cutter 14 has approximately 44 teeth per inch. It has been determined that beard pull is reduced when the lower cutter 12 is reciprocally moved 0.060 inches at 7,500 cycles per minute or at a higher frequency.

Figure 3:
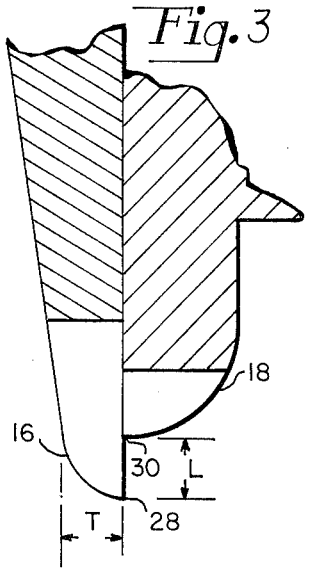
FIG. 3 is a cross-sectional drawing of cutter teeth.

The moving lower cutter 12 is used to rub low-lying facial hairs across the direction of the hair growth causing three hairs to become erect for cutting to the desired length. Thus, if a user should hold the clipper 10 so that a front surface 26 of the lower cutter 12 is in contact with a user's beard, hair is cut to a length determined by a thickness, T, of the lower cutter teeth 16, shown in detail in FIG. 3. Likewise, if the clipper 10 is held by a user so that projecting edges 28 of the lower teeth 16 are in contact with a user's beard, hair is cut to a length determined by a length, L, that the lower cutter teeth edges 28 project beyond extreme edges 30 of the upper cutter teeth 18. The clipper 10 is prevented from cutting hair at or below the skin line by forming the lower cutter teeth 16 to have a uniform thickness, T, substantially equal to the projecting length, L, which would enable the cutters 12 and 14 to shear hair to a length substantially equivalent to about 0.010 inches.

Figure 4:
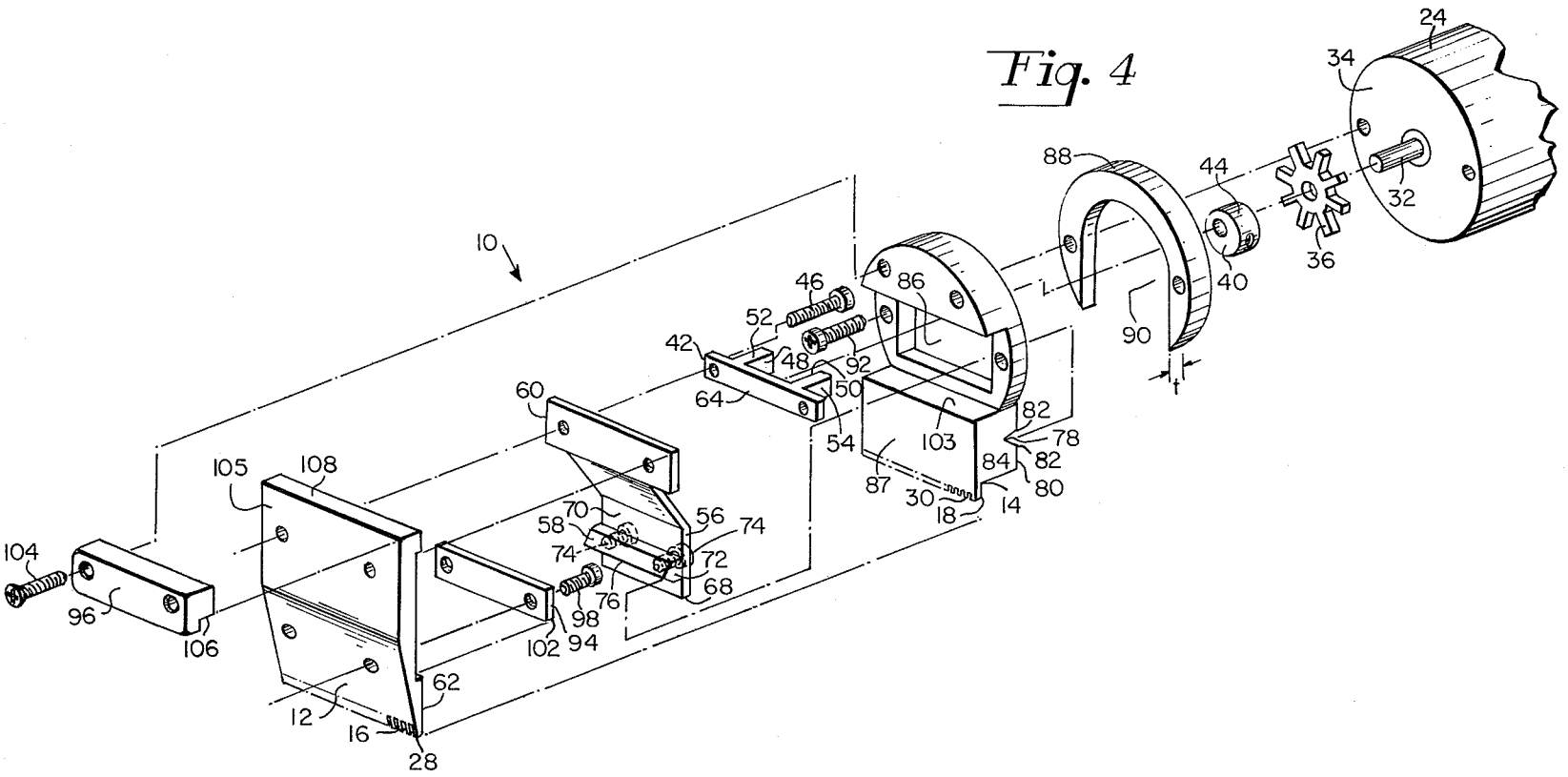
FIG. 4 is an assembly drawing of one embodiment of the hair clipper.

Referring to FIG. 4, there is shown an assembly drawing useful in understanding the operation of the hair clipper 10. The motor, M, which causes the lower cutter 12 to move includes a rotatable motor shaft 32 extending from one end 34 of the housing 24. An example of a suitable motor, M, for rotating the motor shaft 32 and moving the lower cutter 12 at a speed for efficiently cutter hair with minimum beard pull is rated at 0.01 HP at 7,500 to 15,000 RPM. It is understood that an AC motor would also be suitable for operating the clipper 10. A fan 36 is attached to the motor shaft 32. The fan 36 rotates with the motor shaft 32 to provide a flow of air against the cutters 12 and 14 to dissipate heat generated by friction resulting when the lower cutter 12 moves against the upper cutter 14. An eccentric assembly comprising a disc 40 and a transmission member 42 is adapted to enable the lower cutter 12 to move laterally in response to a rotational movement of the motor shaft 32. In particular, the motor shaft 32 is keyed eccentrically through the disc 40 so that as the motor shaft 32 and disc 40 rotate, successive points on a rim 44 of the disc 40 describe a reciprocating lateral path. The transmission member 42 is connected by screws 46 to the lower cutter 12 and assembled in the hair clipper 10 so that the rotating disc rim 44 fits close to the inside surfaces 48 and 50 of first and second stops 52 and 54 extending outwardly from the transmission member 42. When the stops 52 and 54 are sequentially pushed by the disc rim 44, the transmission member 42 and lower cutter 12 are caused to move laterally and reciprocally in a direction substantially parallel to the upper cutter teeth edges 30.

Means for flexibly holding the lower cutter 12 against the upper cutter 14 include a spring member 56 and a slider 58.. The spring member 56 has a bottom portion 60 held between a rear surface 62 of the lower cutter 12 and a front surface 64 of the transmission member 42 by the screws 46. An upper portion 68 of a front surface 70 of the spring member 56 is attached to a substantially flat rear surface 72 of the slider 58 by screws 74. The slider 58 has a protruding front surface 76 shaped to conform with a V-shaped notch 78 in a rear surface 80 of the upper cutter 14. The notch 78 in the upper cutter 14 is formed to have longitudinal edges 82 and an apex 84 extending in a direction substantially parallel to the cutter teeth edges 30, whereby the slider 58 may freely move laterally in the notch 78 in a direction substantially parallel to the upper cutter teeth edges 30.

The upper portion 68 of the spring member 56 and the stops 52 and 54 of the transmission member 42 extend through an aperture 86 in the upper cutter 14 so that the front surface 76 of the slider 58 is received in the notch 78 in the rear surface 80 of the upper cutter 14 and the stops 52 and 54 are located close to the disc rim 44. The spring member 56 is formed to provide sufficient force for holding the slider 48 in the notch 78 and the rear surface of the lower cutter 12 against a front surface 87 of the upper cutter 14 while permitting the slider 58 to freely move laterally in the notch 78. The lower cutter 12 is attached to the spring member 56 and transmission member 42 is that extreme edges 28 of the lower cutter teeth 16 move laterally in a direction substantially parallel to the extreme edges 30 of the upper cutter teeth 18 in response to a lateral movement of the transmission member 42.

A spacer 88 having an aperture 90 is connected by screws 92 between the rear surface 80 of the upper cutter 14 and the motor housing end 34. The motor shaft 32, fan 36, disc 40, and transmission member stops 52 and 54 are disposed in the spacer aperture 90. The spacer aperture 90 and spacer thickness, T, are dimensioned to permit free movement of the transmission member 42, fan 36, motor shaft 32 and disc 40.

Means for determining the projecting length, L, of the lower cutter 12 includes first and second locator members 94 and 96. The first locator member 94 is attached by screws 98 to the rear surface 62 of the lower cutter 12 to provide an outwardly projecting lip 102 or ridge which cooperates with a lip 103 on the front surface 87 of the upper cutter 14 to prevent the lower cutter 12 from moving toward the upper cutter teeth edges 30. The second locator member 96 is attached to the front surface 87 of the upper cutter 14 by the screws 104. An L-shaped notch 106 is formed in the second locator member 96 to provide a bearing surface for a bottom edge 108 of the lower cutter 12 and to prevent the lower cutter from moving away from the upper cutter teeth edges 30.

One embodiment of the invention has been shown and described only by way of example. Various other embodiments and modifications thereof will be apparent to those skilled in the art, and will fall within the scope of the invention as defined in the following claims.

What is claimed as new and desirous to be secured by Letters Patent of the United States is:

1. A hair clipper comprising:

a housing;

a first cutter having a plurality of teeth;

a second cutter having a plurality of teeth, said second cutter being assembled between said housing and said first cutter with said first cutter teeth projecting beyond said second cutter teeth;

means for flexibly holding said first cutter against said second cutter including a spring member having one end connected to said first cutter and means for slidably coupling a spring member end opposite said one end to a slot in said second cutter; and means for reciprocally moving said first cutter teeth against a skin surface and against said second cutter in a lateral direction substantially parallel to extreme edges of said second cutter teeth for raising hairs for cutting between said first and second cutter teeth.

2. A hair clipper according to claim 1, wherein said means for reciprocally moving said first cutter includes a motor disposed within said housing, said motor having a motor shaft extending from one end of said housing and keyed eccentrically through a disc, said motor being operated to rotate said disc to strike a transmission means connected to said first cutter causing said reciprocal movement of said first cutter.

3. A hair clipper according to claim 1, wherein said first cutter has more teeth than said second cutter.

4. A hair clipper according to claim 1, wherein said teeth of said first cutter have a thickness substantially equal to said projection of said first cutter teeth beyond said second cutter teeth.

5. A hair clipper comprising:

a housing;

a movable first cutter having a plurality of teeth;

a stationary second cutter having a plurality of teeth, said second cutter being connected to said housing between said fitst cutter and said housing;

means for flexibly holding said first cutter against said second cutter with said first cutter teeth projecting beyond said second cutter teeth including a spring member having one end connected to said first cutter and means for slidably coupling a spring member end opposite said one end to a slot in said second cutter; and means for reciprocally moving said first cutter against said second cutter in a lateral direction substantially parallel to extreme edges of said second cutter teeth.

6. A hair clipper according to claim 5, wherein said means for reciprocally moving said first cutter against said second cutter includes a motor disposed within said housing, said motor having a motor shaft extending from one end of said housing and keyed eccentrically through a disc, said motor being operated to rotate said disc to move a transmission means connected to said first cutter causing said reciprocal movement of said first cutter 7. A hair clipper according to claim 5, wherein said first cutter has more teeth than said second cutter.

8. A hair clipper according to claim 5, wherein said teeth of said first clipper have a thickness substantially equal to said projection of said first cutter teeth beyond said second cutter teeth.

* * * * *

UNITED STATES PATENT AND TRADEMARK OFFICE

CERTIFICATE OF CORRECTION

PATENT NO. : 4,106,190

DATED : August 15, 1978

INVENTOR(S) : Allan C. Harper and Edmund M. Buras, Jr.

It is certified that error appears in the above-identified patent and that said Letters Patent are hereby corrected as shown below:

Column 2, Line 45, "three" should read --these--.

Column 2, Line 68, "cutter" should read --cutting--.

Column 3, Line 53, "is" should read --so--.

Column 4, Line 59, "fitst" should read --first--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*